US010300326B2

(12) United States Patent
Warren

(10) Patent No.: US 10,300,326 B2
(45) Date of Patent: May 28, 2019

(54) CORE AMORTIZATION TIME UNDER TENSION METHOD AND APPARATUS

(71) Applicant: David J. Warren, Buffalo Grove, IL (US)

(72) Inventor: David J. Warren, Buffalo Grove, IL (US)

(73) Assignee: David J. Warren, Buffalo Grove, IL (US)

( * ) Notice: Subject to any disclaimer, the term of this patent is extended or adjusted under 35 U.S.C. 154(b) by 195 days.

(21) Appl. No.: 15/617,055

(22) Filed: Jun. 8, 2017

(65) Prior Publication Data

US 2018/0043204 A1 Feb. 15, 2018

Related U.S. Application Data

(60) Provisional application No. 62/372,924, filed on Aug. 10, 2016.

(51) Int. Cl.
*A63B 21/00* (2006.01)
*A63B 21/04* (2006.01)
(Continued)

(52) U.S. Cl.
CPC ..... *A63B 21/4009* (2015.10); *A63B 21/0442* (2013.01); *A63B 21/0557* (2013.01); *A63B 21/0726* (2013.01); *A63B 21/16* (2013.01); *A63B 23/0211* (2013.01); *A63B 21/0023* (2013.01); *A63B 23/0405* (2013.01);
(Continued)

(58) Field of Classification Search
CPC ..... A63B 21/4009; A63B 21/4043; A63B 21/4045; A63B 21/04; A63B 21/0442; A63B 21/02–0557; A63B 21/0618; A63B 21/16–169
See application file for complete search history.

(56) References Cited

U.S. PATENT DOCUMENTS 2,893,736 A * 7/1959 Tesi ..... A63B 69/0059 473/216
3,988,020 A * 10/1976 Carter ..... A63B 69/12 482/55

(Continued)

*Primary Examiner* — Nyca T Nguyen
(74) *Attorney, Agent, or Firm* — Adam K. Sacharoff; Much Shelist, P.C.

(57) ABSTRACT

The present invention uses a belt around the waist, elastic bands attached to the waist belt and an anchoring system to create simultaneous constant tension on the core and body movement systems during physical exercise in the three planes of motion (sagittal, transverse and frontal). The tension created causes perturbation (balance) challenges forcing the lower and upper body to work synergistically to overcome the load put on the entire muscular system. Since the tension is simultaneous, constant and multi-planar, it overloads the core and lower body movement systems ("Lumbo-Pelvic-Hip Complex"), separately challenging the transverse abdominus, internal obliques, pelvic floor, multifidus, and deep erector spinae group while the physical exercise is being performed. By achieving this, the present invention produces superior physiological results during physical exercise for athletic training, fitness maintenance, and physical therapy and rehabilitation, in a less costly and more time-efficient manner.

16 Claims, 10 Drawing Sheets

(51) Int. Cl.

| | |
|---|---|
| ***A63B 21/16*** | (2006.01) |
| ***A63B 23/02*** | (2006.01) |
| ***A63B 71/02*** | (2006.01) |
| ***A63B 21/055*** | (2006.01) |
| ***A63B 21/002*** | (2006.01) |
| ***A63B 21/072*** | (2006.01) |
| *A63B 23/04* | (2006.01) |

(52) U.S. Cl.
CPC ..... *A63B 23/047* (2013.01); *A63B 2023/0411* (2013.01); *A63B 2071/024* (2013.01)

(56) References Cited

U.S. PATENT DOCUMENTS 5,306,222 A 4/1994 Wilkinson
5,372,565 A 12/1994 Burdenko
5,512,029 A * 4/1996 Barnard ..... A63B 21/0552 482/124
5,613,926 A * 3/1997 Michaelson ..... A63B 21/0552 482/121
5,647,827 A * 7/1997 Gutkowski ..... A63B 21/0004 482/122
5,924,933 A * 7/1999 Pacheco ..... A63B 69/36 473/216
6,012,993 A * 1/2000 Guerriero ..... A63B 21/0552 182/3
7,104,932 B1 * 9/2006 Brentlinger ..... A63B 69/12 434/254
7,850,583 B2 12/2010 Smith
7,931,571 B2 4/2011 Bernardoni
9,242,159 B1 * 1/2016 Lacoste ..... A63B 69/0002
9,427,622 B2 * 8/2016 Thrasher-Rudd ..... A63B 7/00
2007/0083975 A1 * 4/2007 Senegal ..... A63B 21/0552 2/102
2009/0051131 A1 * 2/2009 Warrington ..... A45F 3/14 280/19
2010/0022364 A1 1/2010 Bocchicchio
2011/0021329 A1 * 1/2011 Dunne ..... A63B 21/0552 482/124
2012/0197168 A1 * 8/2012 Agrawal ..... A61H 3/008 602/19
2013/0045842 A1 2/2013 Wood
2013/0130866 A1 * 5/2013 Wehrell ..... A61H 1/0229 482/5
2013/0130874 A1 5/2013 Richardson
2016/0310811 A1 * 10/2016 Bledsoe ..... A63B 69/0059
2017/0326403 A1 * 11/2017 Castaneda ..... A63B 23/02

* cited by examiner

CORE AMORTIZATION TIME UNDER TENSION METHOD AND APPARATUS

CROSS REFERENCE TO RELATED APPLICATIONS

The present invention claims priority to U.S. Provisional Application 62/372,924 filed Aug. 10, 2016, which is incorporated in its entirety herein by reference.

FIELD OF THE INVENTION

The present invention is a tension based exercise device that focuses loading on the core muscle stabilizers both locally and globally. Its revolutionary design applies tension and loading through a multi-planar venue in the core and lower body movement systems.

BACKGROUND OF THE INVENTION

The prior art is littered with numerous tension based exercise devices. These devices have a tendency to be either overly simplistic or very complicated, cumbersome, expensive, ineffective, or difficult to use. No fitness product on the market has thus far shown the effectiveness, versatility, portability and low price point like the present invention. Prior art equipment that utilize belt and loading systems do not provide multi-planar tension (sagittal, transverse, and frontal) on the user's body to challenge various locations on the body while at the same time providing cardiovascular impact.

SUMMARY OF THE INVENTION

What makes the present invention unique is that it also has cardiovascular effects. The cardiovascular impact along with the multi-joint movements creates an extremely safe and efficient training platform that can push even the most elite athletes. The present invention is not just unique, but rather ideal because it allows for a wide variety of exercises: it can be used by itself or integrated into other training protocols and it can be used with weights or a person's body weight. All that is needed is three elastic bands, a belt attachment system, and an anchoring mechanism.

Unlike other tension devices, with the present invention, the muscles in the core and lower body movement systems are under simultaneous, continuous cumulative stress during the exercise regime. This simultaneous, cumulative, continuous stress provides users a substantially greater physical and cardiovascular workout than they would otherwise receive through other conventional workout routines or exercise equipment.

A number of key features differentiate the present invention from other exercise equipment currently in the marketplace and from the prior art: The present invention: (A) provides a unique workout through simultaneous, constant loading of core and lower body movement systems, even at rest; (B) loads the body in all three planes of motion (sagittal, transverse, and frontal), thereby creating a three dimensional workout; (C) creates a constant load on the cardiovascular system by creating a continuous effort by the heart, resulting in a sustained elevation of the heart rate, which also provides a greater caloric burn; (D) increases anaerobic stress on both the fast-twitch and slow-twitch muscle fibers; (E) is comprised of a unique and central belt system; (F) contains a belt which is configured to have a two clip belt attachment system, which allows for easy transfer from a vertical position to a horizontal position, while still providing continuous lines of tension throughout the body; (G) can be used in a variety of exercise and training applications from sports skill enhancement training to injury rehabilitation to intensified cardiovascular stress while using cardiovascular equipment; (H) provides easy adjustments to accommodate a variety of individual body physiologies; and (I) allows for simple placement and removal of the belt.

Numerous other advantages and factors of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DESCRIPTION OF THE EMBODIMENTS

Figure 1:
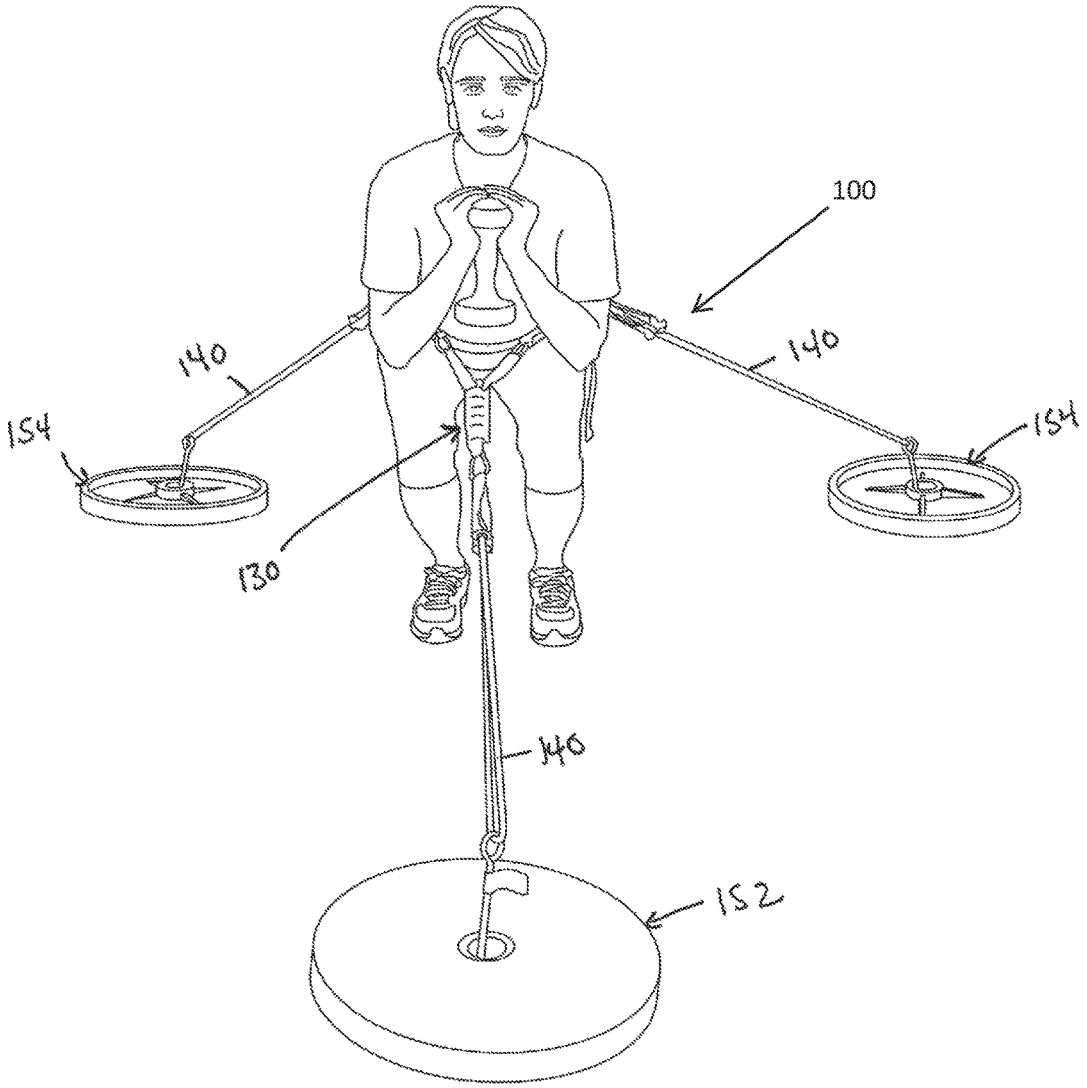
FIG. 1 shows one embodiment of the invention in use.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims by the embodiments illustrated.

Figure 2:
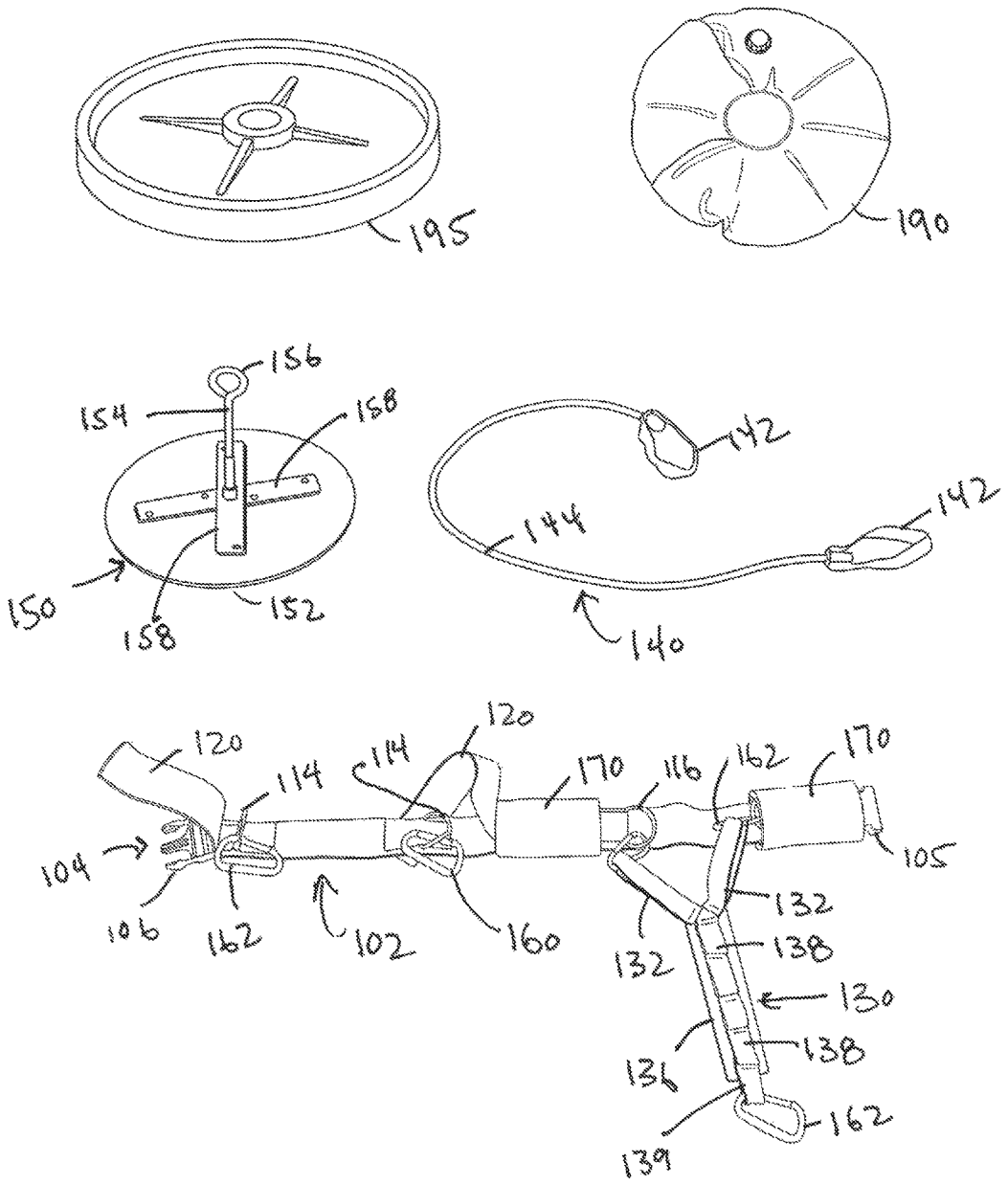
FIG. 2 illustrates one embodiment of the components of the invention.
Figure 3:
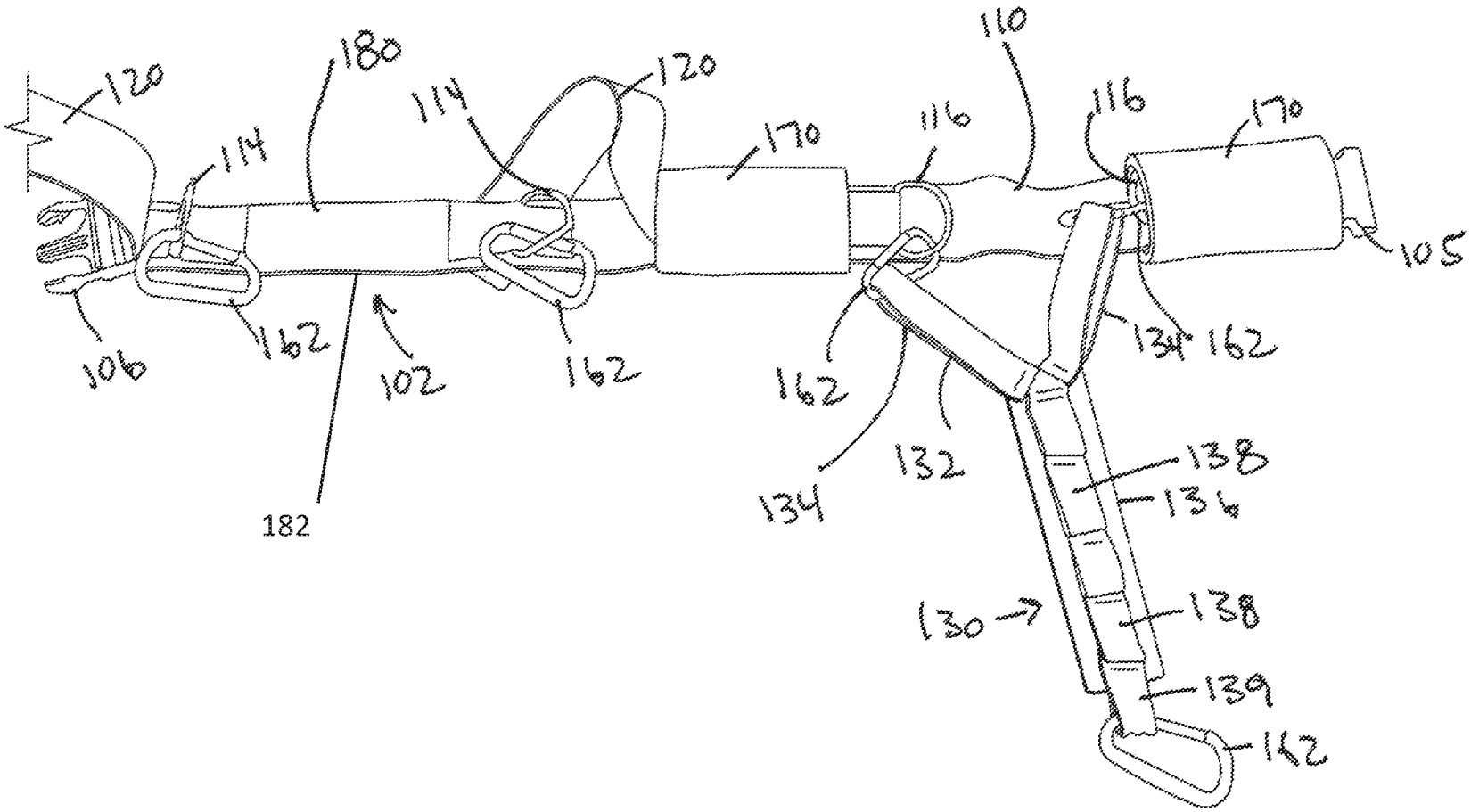
FIG. 3 illustrates a web belt in accordance with one embodiment of the invention.
Figure 4:
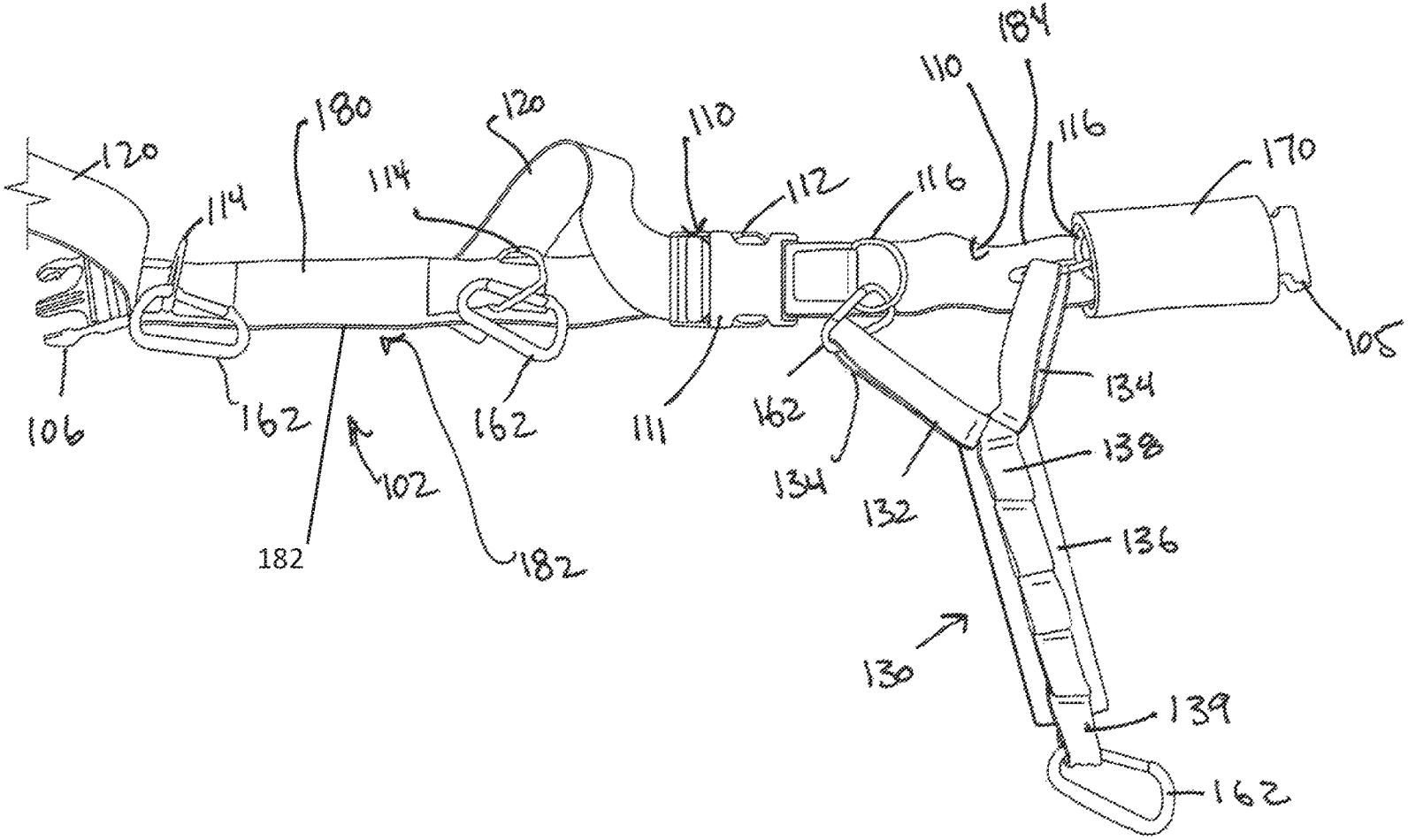
FIG. 4 illustrates a web belt in accordance with another embodiment of the invention.
Figure 5:
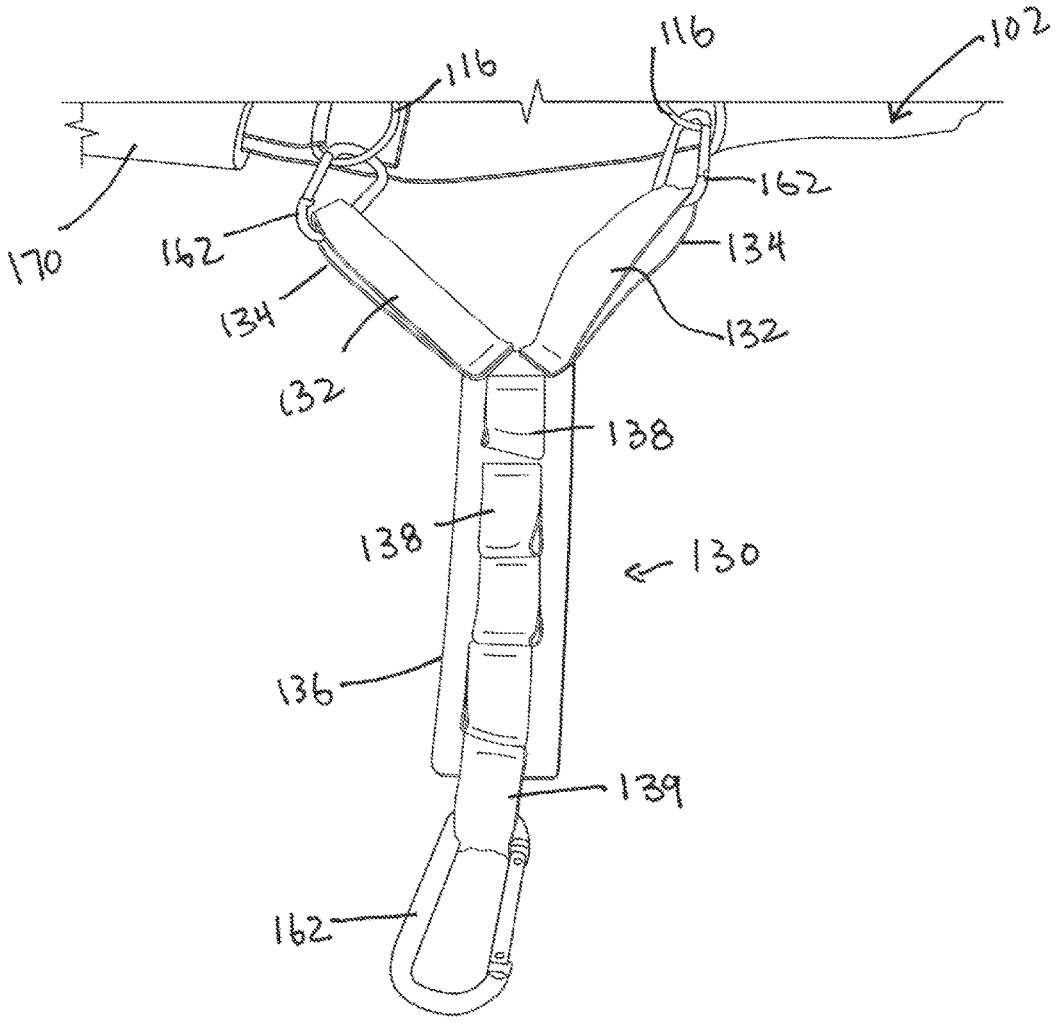
FIG. 5 illustrates a Y assembly secured to a web belt in accordance with another embodiment of the invention.
Figure 6C:
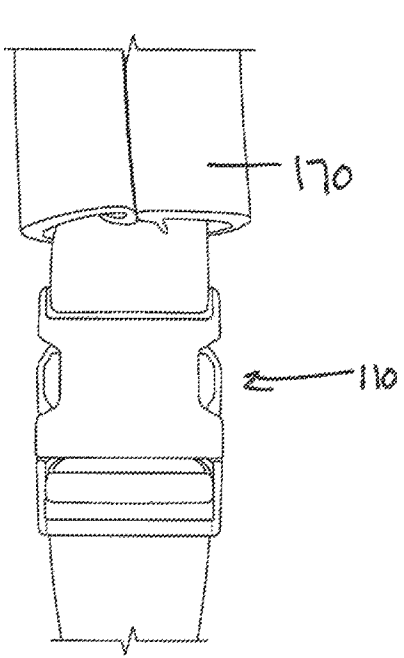
FIGS. 6A-6C illustrates the web belt being secured around the waist of a user in accordance with another embodiment of the invention.
Figure 6B:
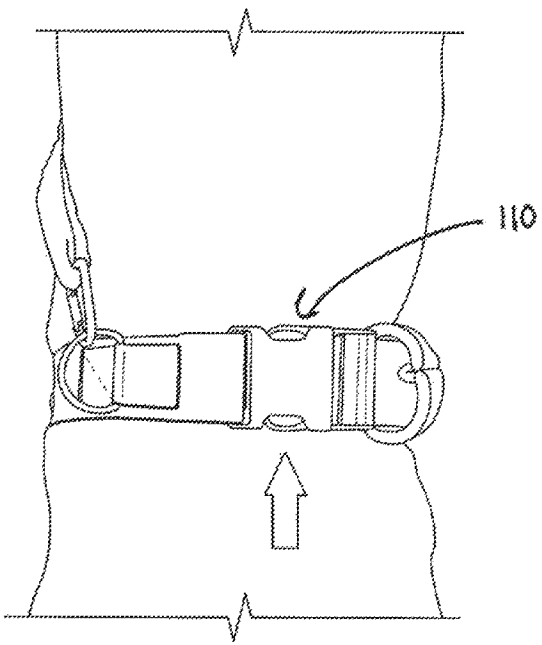
Figure 6A:
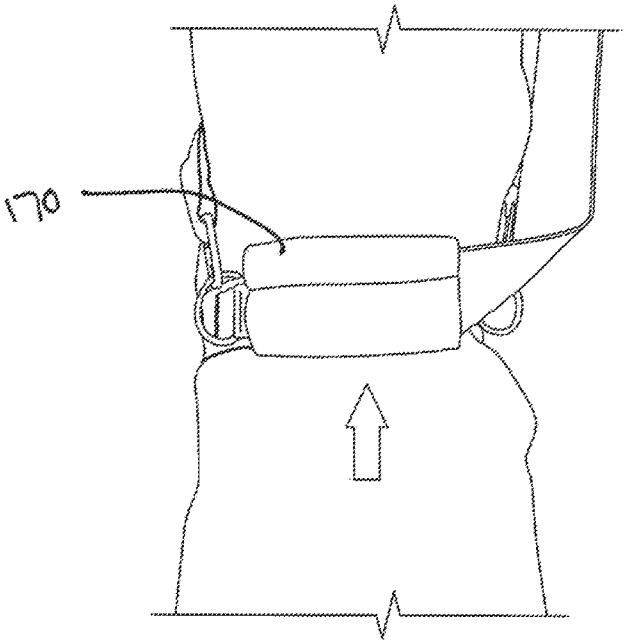
Figure 7:
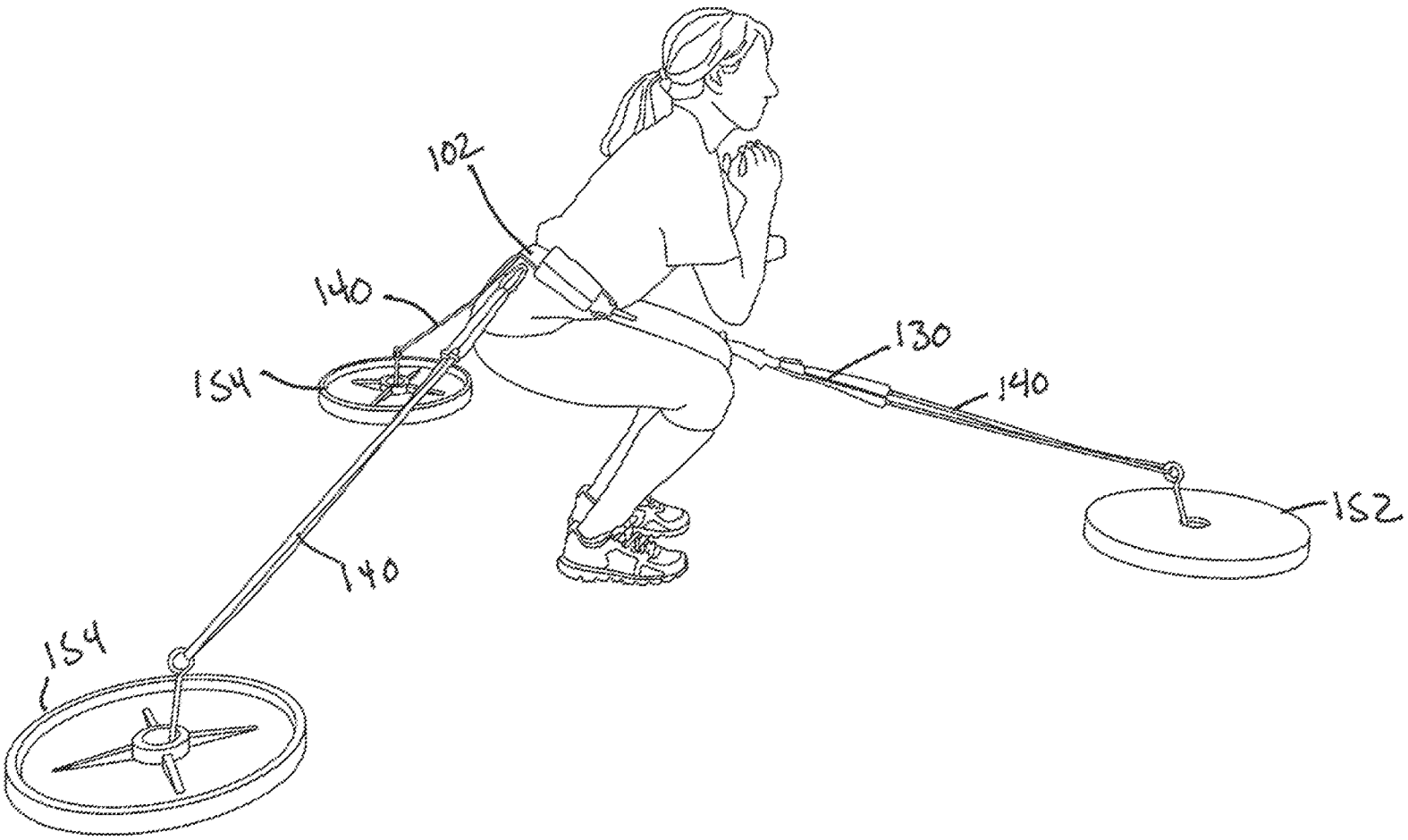
FIG. 7 illustrates an embodiment of the invention in use from the side of the user.
Figure 8:
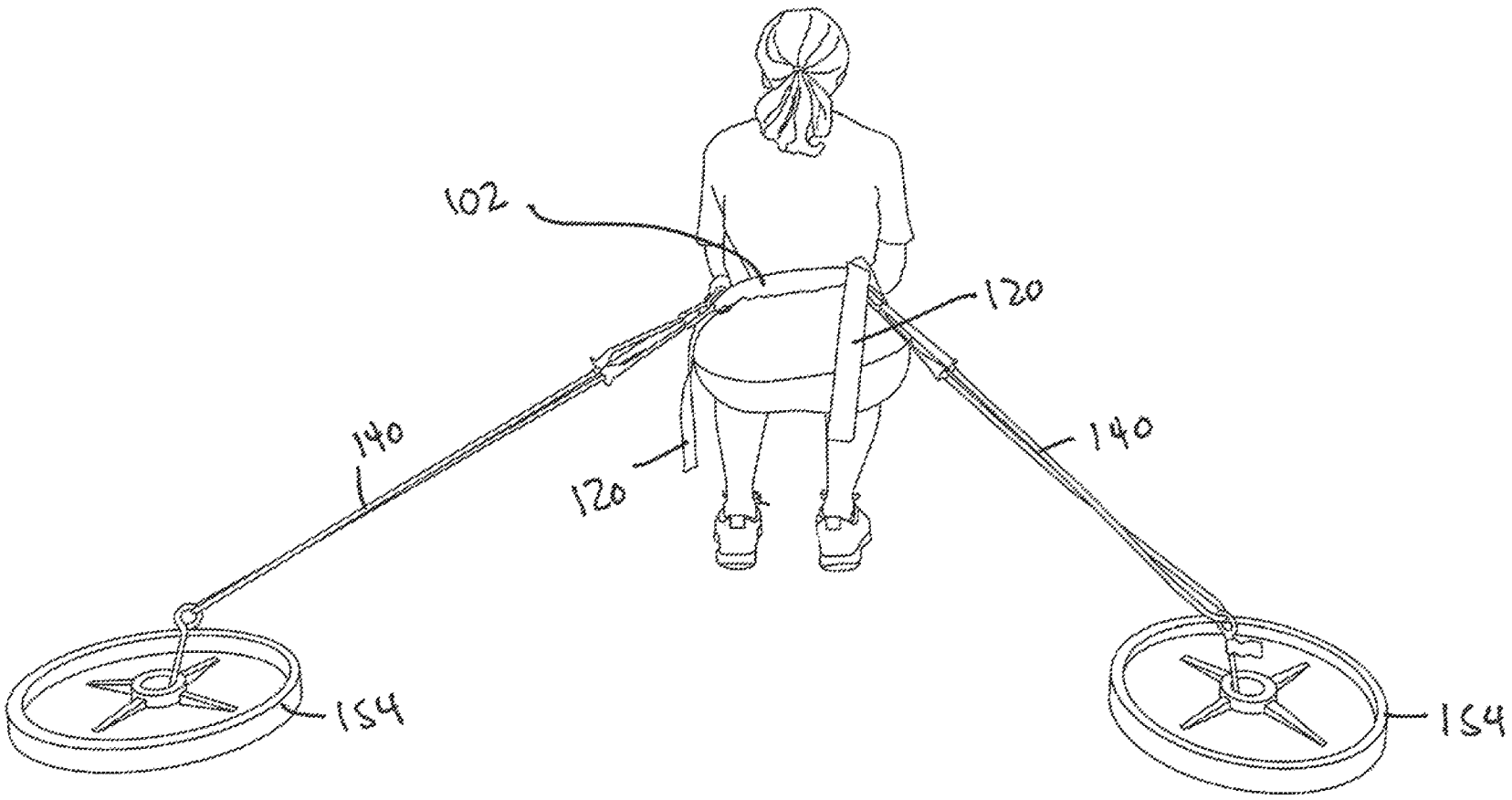
FIG. 8 illustrates an embodiment of the invention in use from behind the user.
Figure 9:
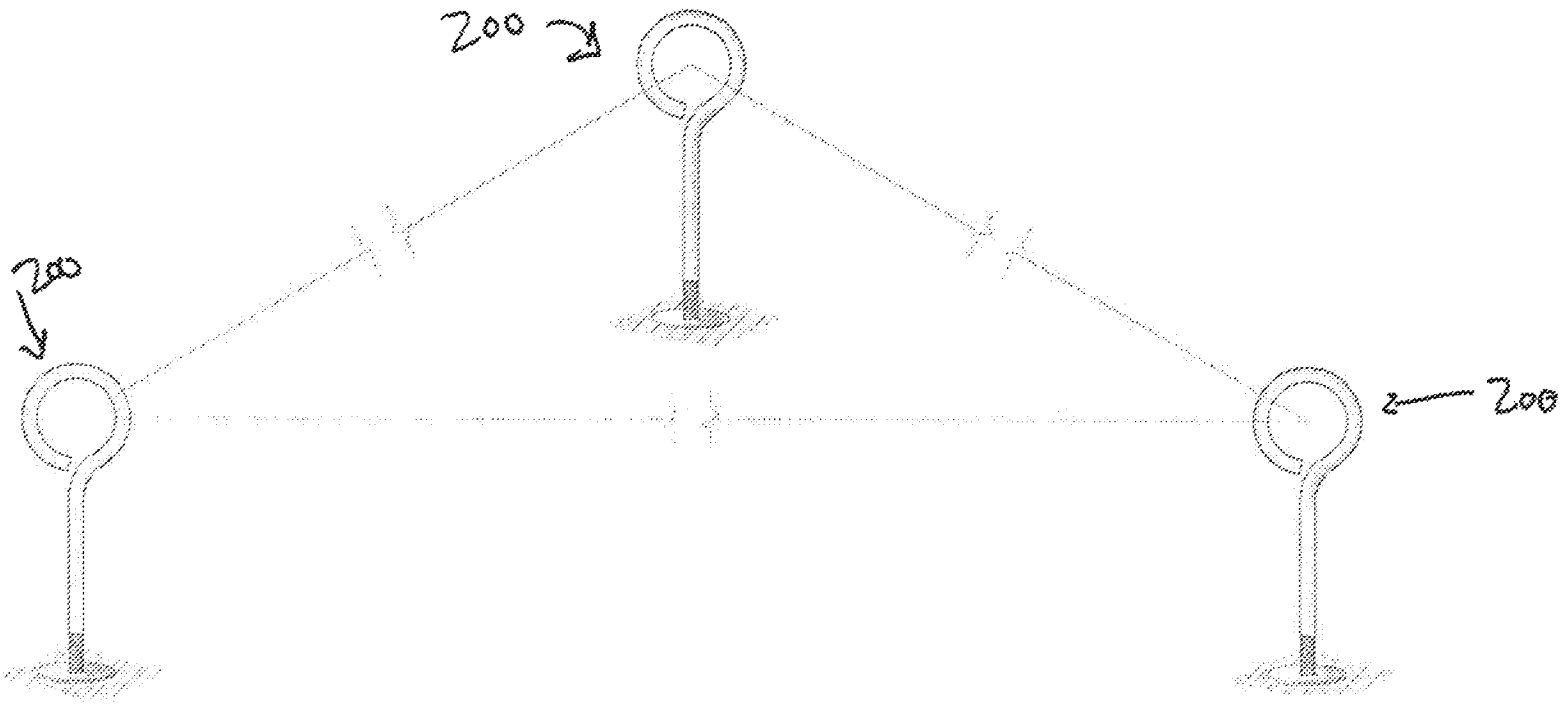
FIG. 9 illustrates an anchor system in accordance with another embodiment of the invention.
Figure 10:
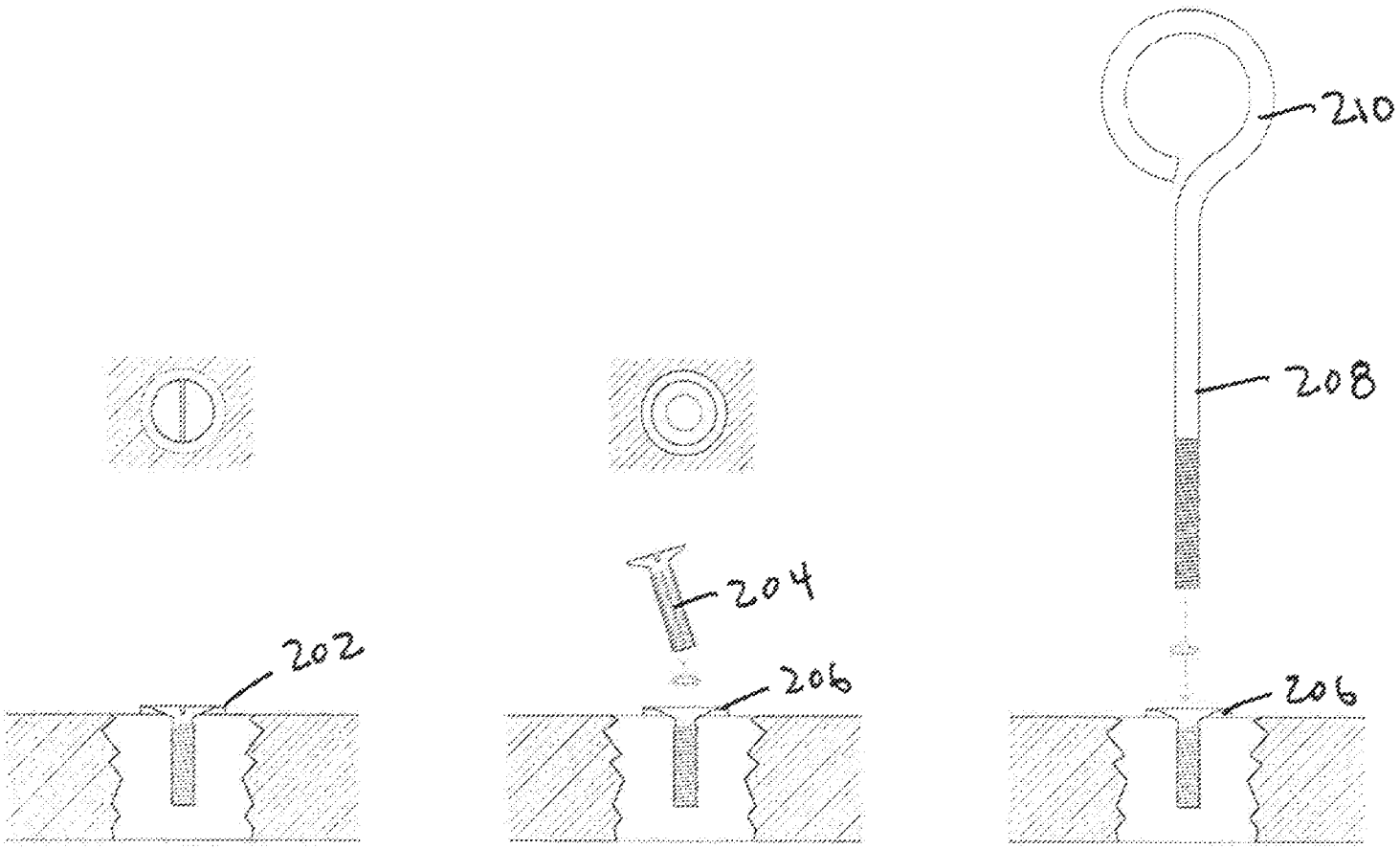
FIG. 10 illustrates one type of anchor system in accordance with another embodiment of the invention.

Referring now to FIGS. 1 through 10, the present invention provides an equipment system 100 that includes:

a. a WEB belt 102 with Y assembly 130
b. three elastic bands 140
c. three Anchoring devices and/or three anchors 150
d. five Securing/Safety clips 160
e. two Neoprene sleeves 170
f. a Neoprene belt stabilizer 180 (used to keep belt stabilized around hips) and
g. three 45 lb. water weight anchors 190, which can be substituted with three 45 lb. plates 195 (typically not included in the system but shown and illustrated).

As provided, the web belt 102 is a belt 110 that is separated into front and rear belt components 182 and 184, respectively. The two belt components are connected by two fastener clips (defined herein) and are further defined by a rear neoprene belt stabilizer 180. The two fastener clips are defined to include a $1^{st}$ fastener clip 104 with a defined $1^{st}$ female clip end 105 and a $1^{st}$ male clip end 106, and a $2^{nd}$ fastener clip 110 positioned between the 1st female/male clip ends. The 2nd fastener clip 110 includes a defined 2nd female clip end 111 and a 2nd male clip end 112. The ft fastener clip 104 allows adjustment to the overall length of the web belt around the waist, while the 2nd fastener clip 110 allows slight adjustments of the placement of the Y assembly. The web belt 102 includes 4 D rings; two of the D rings 114 are positioned between the ft female clip end 105 and the 2nd male clip end 112, while the other two D rings 116 are positioned between the 1st male clip end 106 and the 2nd female clip end 111. When worn, the positioning of the D rings will be configured such that two are behind the user, while the other two will be configured in front of the user.

The Y assembly 130 can be secured to the two D rings 116 in front of the user. The Y assembly 130 includes two arms 132 with looped ends 134 positioned at the end of each arm. The two arms 132 further extend out from a central leg 136. The central leg 136 includes a plurality of fabric loops 138.

Each of the five securing/safety clips 160 may be simply metal carabiners 162, well known and defined in the prior art.

Each of the elastic bands 140 includes a loop or fabric handle 142 on the two ends of an elastic tubing 144.

Each of the anchoring devices 150 is defined as a base plate 152 designed to rest on a floor or surface with a rod or bolt 154 extending from the base plate 152. The upper end of the bolt 154 further includes an eye hook 156. A pair of cross bars 158 may be further used to secure the lower end of the bolt 154 to the base plate 152.

In the method of assembly and using the present invention:

Step 1: Place anchoring devices 150 in a triangle pattern on the floor. Make sure the front anchor 152 placement is approximately 7 ft. from the back anchors 154. The two back anchors should be approximately 4 ft. apart from one another.

Step 2: Place 45 lb. weights onto the anchoring devices 150 to secure the anchoring devices 150 to the floor. The 45 lb. weights can either be the water weights 190 or plates 195. As further provided, alternatively, the anchoring devices can be directly secured to the floor (discussed below).

Step 3: Separately thread each of the elastic bands 140 through one of the metal eye hooks 156.

Step 4: Secure the web belt 102 around the waist, clipping the 1st and 2nd male/female clips 104 and 110 together. To properly fit the belt, either tighten or loosen the fabric belts 120 through the clip fasteners 106/108. Place neoprene sleeves 170 over the clip fasteners 106/108. Attach the Y assembly 130 to D rings 116 with carabiners 162 and place a carabiner 162 through the last loop setting 139 on the Y assembly 130. The user should make sure that the belt fits snug.

Step 5: Move towards the rear anchors 154 and attach two of the elastic band loops or fabric handles 142 to the two rear "D" rings 114 by putting them on the 2 safety clips 162 attached to the back of belt 102. The elastic band tubing 140 should then loop through the eye hooks 156 on the rear anchors 154 and the other elastic band loops 142 should then be attached to the same D rings 114.

Step 6: Before attaching the Y assembly 130 make sure all the safety clips are secured.

Step 7: Move towards the front anchor 152, place the front fabric loop (part of Y assembly) using the safety clip on to the front elastic band 140 by placing the fabric handles 142 on the safety clip attached to the last fabric loop 139 on the Y assembly.

Step 8: To create more or less tension, move front carabiners 162 up or down the fabric loops 138 on the Y assembly 130. The closer the carabiner is to the belt, the greater the tension. The closer the clip is to bottom of the Y assembly or the closer to the anchor, the less tension.

Step 9: To remove the belt, press down on the belt clips with fingers and squeeze towards the center. Make sure to move the neoprene sleeve backwards or forwards so that you can reach the plastic belt clips.

Step 10: To end the use of the belt, remove the belt clip fastener then remove the safety clips from the tension bands. Take the bands off the "eye" hook by pushing them through the center of "eye" hook. Then remove the weight off the anchors. It is noted that it is easier, faster and safer to move the weight in towards the belt before taking the safety clips off.

Step 11: Place all items back into the bag, keep safety clips attached to the belt so that they do not get lost or misplaced.

Note that the neoprene belt stabilizer only needs to be used to keep the belt from sliding down the hips. Secure fit by sliding it over the rear D rings in the back of the belt. As a precaution, the user should always check bands for signs of wear or breakage. If any sign of cracking, replace band with a new one. Children should be supervised by an adult while using the present invention and the present invention should not be used by children under the age of 14.

As an alternative embodiment of an anchoring system, floor anchors 200 can be directly secured to the floor. Anchor screws 202 are first fastened into the floor. The screw 204 is then removed leaving the threaded anchor 206 in the floor. A bolt 208 with an eye hook 210 is then threaded into the threaded anchor 206. The elastic bands 140 can then be secured directly to the eye hooks 210, without the need for weights. Floor anchors 200 are helpful because the user does not have to be concerned with the weights shifting during use. The distance between the floor anchors is also set to ensure proper training and fitness in accordance with the methods developed and disclosed herein.

Alternatively, the waist belt can be defined to include a front component and a rear component. The waist belt includes first and second fastener clips between the components such that the first fastener clip when closed is configured to close the waist belt around the user and configured to adjust a rear length of the waist belt around the user's waist, while the second fastener clip when closed is configured on the waist belt to adjust a front length of the waist belt, such that a position of the Y assembly on the waist belt is adjustable.

How Components of the Present Invention Function:

The first thing is to place the 3 anchoring devices around the user. Each anchor has a circular pad which has one eye bolt attached to the center. The anchors should be placed about seven feet apart forming a triangular pattern. One anchor will be fixed to the present invention's belt/harness via safety clips. This allows the canvas loops of the "Y" assembly to attach to the "D" rings fastened to the present invention's belt/harness. The "Y" assembly allows the belt/harness to pivot and still keep lines of tension in both a vertical and horizontal orientation. No other prior art has this feature. After placing the anchor in place, the user must then load the anchor which is made up of a non-skid pad with an eye bolt (or hook) attached in the center.

The user does this by putting either a 45 lb. plate over the eye bolt or by placing a 45 lb. water filled "donut" shaped weight over the 3 eye bolt pad anchors. After placing the weighted weights over the anchors, the user must then attach elastic bands by threading them through the eye bolt hole. The fabric straps are then attached to both ends of each of the 3 elastic bands and then inserted into the aluminum safety clips by opening up the spring bar mechanism on each of the safety clips. Once the elastic fabric straps are all securely fastened then the belt/harness can be put on and secured.

The user will first fasten the belt using the plastic belt clips which can be found on the right and left side of the user. The plastic belt clips have a locking device that holds the plastic clips together by pressing the 3 prong locking mechanism into the opposing fastener. After securing the belt clips the user must then tighten both ends of the belt strap to assure that the belt fits securely.

Next, the neoprene sleeves should be fitted over the plastic belt clips to protect the user from irritation due to the belt clips rubbing against the user. All of the elastic bands must be attached to the "D" rings using the elastic band fabric loops. Also, the user must also make sure the 2 fabric loops (that form a "Y") which is part of the "Y" assembly are fastened to the "D" rings in the front of the belt by attaching them using the aluminum safety clips. The user will then attach the back anchors by pulling the elastic bands with the fabric loops (which have the aluminum safety clips on them) which then fasten to the "D" rings on the rear part of the belt/harness. Once the safety clips are fastened into the "D" ring and secured to the belt, the user must finally secure the long part of the "Y" assembly to the front anchor using the first fabric loop on the "Y" assembly.

The multi-looped strap which is made of canvas and nylon has specially made fabric loops to allow the user to increase or decrease tension in front of the belt to keep all the elastic bands tight.

To use the belt/harness the user is attached to the three elastic bands and anchors, while standing in the center. This provides the user with equal lines of stress in all three planes of motion: the sagittal, frontal, and transverse.

This is different from all previous artwork because the prior art does not provide loading in all three planes of motion. The present invention provides autonomous use of both upper and lower body movement systems, while working out in either a horizontal or vertical orientation which the prior art does not. Even more impressive is the fact that this can be accomplished without having to detach yourself from the belt/harness.

The present invention provides the user with a plethora of exercise variations to attain one's fitness goals. The present invention is more versatile then the prior art and can be easily integrated with other training-modalities.

Overview

The present invention integrates both local and global stabilizers of the core while simultaneously recruiting both upper and lower movement systems. We attribute this to the way this unique device continuously exerts constant demands on both core stabilizers and the lower extremities. This can be illustrated by the increased level of demand that is created on the cardiovascular system. It also contributes to the amortization of stress put upon the lower body musculature.

To achieve this impressive physiological effect, it is important to adhere to a particular exercise protocol. This exercise protocol combines full body kinetic activities that use multi-joint movements with both a proprioceptively rich environment and a traditional strength and power exercise routine. This exemplifies the present invention's tremendous versatility in providing acute exercise variables. Included in these acute exercise variables are plyometric movements.

In order to establish an exercise template that implements sound functional protocols using the present invention, it is necessary to adhere to certain physiological principles that are immutable and applicable to all.

For the mechanism of general adaption syndrome to occur we need to apply a logic-based, scientific program that continuously transforms and undulates to the body's ability to adapt and overcome stress, which is the basis of increasing athletic ability and overall fitness. The present invention addresses the entire kinetic chain while providing functional movement modalities that preclude improper exercise protocol. This will prevent over-pattern use syndrome, reciprocal inhibition, synergistic dominance, other altered movement patterns, as well as other dysfunctions.

To provide the most comprehensive training regimen, it is necessary to integrate established training models along with all the different nuances that the present invention has to offer.

The present invention is amenable to already established training models developed by the National Academy of Sports Medicine (N.A.S.M). The present invention's programming corresponds with many of N.A.S.M's training principles and provides independent applications of its own. There are many examples in which N.A.S.M and the present invention can be applied in tandem with one another.

By following the N.A.S.M protocol in conjunction with the present invention's specifically designed programming, one can engage in hybrid training configurations that will establish a paradigm change in fitness based programs. A variety of approaches to using the present invention in various training methodologies are detailed in the following sections.

General Training Protocol

A key component to the present invention is to set up acute variables such as the amount of repetition, quantity of sets and repetition tempo. To properly integrate these acute exercise variables, it is important to established the specific goals for one's exercise regime. In most cases, the present invention will be used with strength endurance programming being the ultimate goal. For the best results, the present invention programming should follow the protocol for strength endurance training, which is multiple sets of up to 15 repetitions to increase local muscle endurance and decrease body fat with a minute or less of recovery time in horizontal loading. If vertical loading is used, little or no recovery is needed. Vertical loading alternates body parts from set to set whereas horizontal loading stays within the same body part until all the sets for that part are completed.

For best results, as described below, a 4-2-2 repetition tempo can be used using the muscle action spectrum which is divided into three different muscle actions—concentric, eccentric and isometric.

In the concentric contraction the muscle is shortened to overcome resistance. In the eccentric contraction the muscle is lengthened when resistance overcomes a line of tension in the muscle. Isometric is the contractile force remaining constant so no movement occurs in the muscle. The muscle action spectrum gives each contraction a time constraint that the action should be completed in. This allows an increased time under tension enhancing benefit of these muscular contractions. Using the present invention, eccentric contraction should use a 4 count. The isometric contraction should be a 2 count and the concentric contraction should be a 2 count.

Exercise is cumulative so up until a certain point, the body can no longer adapt to the same types of additional stress.

The present invention provides novel stressors to the exercise regime in order to allow for additional physiological adaption.

Integrated Training

It is essential to understand the role that the present invention can play in the integrated training continuum. Performing exercises while wearing the present invention amplifies the stabilization, neuromuscular demand and recruitment patterns put on the prime movers to overcome the perturbation challenges and postural adjustments incurred through increased feedback and activation put on the whole kinetic chain.

By following the exercise continuum using the present invention, the exercise principle of "Specific Adaption to Imposed Demands" can be improved by wearing and using this device.

To develop increased function strength programming, one must start with training using the present invention in a proprioceptively rich environment. As an example, an individual would start with a chest press on a stability ball with the present invention attached. Next, the user would move to an YTA on a stability ball, then to a standing unstable bicep curl to overhead dumbbell press to a tricep extension on the stability ball. All these exercises are performed using vertical loading. The combination of the present invention with vertical loading (alternating body parts from set to set—chest, back, shoulders, biceps, triceps, and legs) then repeating the sequence provides a unique musculo-cardiovascular program.

In addition, integrated within the present invention, individuals can incorporate a peripheral heart action system. This applies an upper body exercise followed by a lower body exercise. An example of using the present invention would be a chest press on a stability ball followed by a multi-planar one-legged leg extension. The extra stress put on the entire kinetic chain using the present invention during these acute exercise variables amplifies the entire training effect not realized with current devices on the market.

Stable Training

The present invention can be incorporated into a stable program where strength and endurance for power sports and more specific performance training is required. As an example, while wearing the present invention one can perform such strength and power moves as a dumbbell curl to an overhead press. The extra tension provided by the present invention increases the overall rate of force production.

This type of programming can be also accomplished with just using the present invention along with calisthenic movements such, as a push-up to a burpee to plyometric knee tucks.

Multi-Joint Movement Training

One of the most beneficial uses of the present invention is with sequential multi-joint movement patterns. One example would be the user performing a squat followed by a step-back lunge, to scapular flexion and hip extension into a lunge in the frontal plane. Repeating this series of motor movement patterns with extra loading provided by the present invention creates greater multisensory conditioning, which will help improve motor learning and increase levels of adaptation to multi-planar environments.

Plyometric and Power Training

In addition to training with the present invention to create muscular endurance and endurance strength and hypertrophy, the present invention provides an excellent platform for plyometric training or power training.

Plyometric training uses the elastic and proprioceptive qualities of muscle fibers to increase the maximum rate of force production in the muscle tissue. Plyometric training increases power, which is how fast and how much muscular force you can generate to move an object, such as yourself.

The mechanical model of plyometrics suggests that muscles respond in a similar way to rubber bands. A rubber band has elastic qualities which are amplified when they are stretched. It stores kinetic energy and releases it when one side is released. Tendons and muscles function in a similar manner. They also have elastic qualities and the ability to store kinetic energy. When the muscles and tendons are loaded in the plyometric fashion, the tension increases and are then released during the concentric contraction.

The amortization phase of an exercise occurs when the kinetic energy stored in the muscles and tendons is released during the explosive concentric contraction of the particular muscle and tendon. The force (amplitude) generated during the amortization phase increases as the amortization phase decreases.

If the present invention is used during a plyometric exercise the rate of force production will increase due to increased loading of the muscles (increased amplitude).

Along with positively enhancing plyometric movements, the present invention also creates mechanical specificity, which is when energy output from specific exercises are increased by forcing greater motor unit recruitment.

This produces heightened energy output caused by increased levels of muscle synergies or different muscles working as one functional integrated unit. The net effect of improved muscle synergy and mechanical specificity through using the present invention is better functional movement patterns and heightened energy output.

In short, the present invention trains specific muscle groups to recruit more muscle fibers during exercise in order to generate more force and energy output.

The present invention facilitates increased activation of Type I and Type II muscle fiber. Type I muscle fibers are responsible for assisting with postural stabilization. These muscle fibers are more readily engaged during perturbation or balance challenges of the Lumbo-Pelvic-Hip Complex, or the core. The postural stabilization system is being challenged by the lines of tension applied to it through the present invention.

Type II muscle fibers also benefit greatly from the present invention. Type II muscle fibers are utilized when doing explosive power movements, such as exerting a maximum effort or a plyometric exercise. These movements require both speed and mass. They express rate of force production or power.

For any exercise regime to be effective, it is paramount to have an abundant amount of kinetic activity which challenges the core and the rest of the movement systems. The present invention achieves this.

The following are examples of dynamic or power movements using the present invention:

a. Straight bar squats or dumbbell squats with the present invention.
b. Deadlift straight bar or dumbbells with the present invention.
c. Clean & jerk using a straight bar or kettle bell with the present invention.

This illustrates the enormous versatility that this device can achieve. The more options provided for the general adaptation syndrome, the more pronounced the results.

In many sports, muscular hypertrophy can inhibit performance; yet strength without size is still desired. One way to achieve this is through neural adaptation which allows greater strength in specific exercises by increasing more efficient recruitment patterns of muscle fibers and motor units in a response to overcome forces put on the neuromuscular system. The present invention has the ability to produce the amount of neuromuscular demand to force this neural adaptation.

Corrective Exercise

The present invention can also be used productively with core corrective exercise training (CET) for physical therapy and rehabilitation training.

For example, the present invention allows for CET exercises, such as multi-planar loading on the core while doing seated hip circles on a stability ball or contralateral seated arm and leg extension on a stability ball.

Another example of how the present invention can increase overall neuromuscular efficiency as well as increase overall objective range of motion is using it after assessing the one functional range of motion while performing a single-leg balance exertion test.

After completing the assessment, the individual needs to perform the same kinetic activity which was demonstrated using the single leg balance while using the present invention. The present invention will increase demand on the Lumbo-Pelvic-Hip Complex facilitating better neuromuscular functionality of the core. The present invention can also be used to perform the excursion test.

The increased neuromuscular efficiency is a direct result of putting increased neuromuscular stress on the core. The present invention has multiple applications that can amplify the benefit of CET exercises.

To reinforce, the present invention can be used in CET in proprioceptively rich environments such as unstable training, in stable and unstable training, in hypertrophy training and in reactive power training, all of which coincide with N.A.S.M training hierarchy. The present invention configuration and compatibility allows it to be used in multiple exercise venues. An effective way to use it is utilizing it while training with one's own body weight. What is so unique and special about training this way is that no equipment is needed and the intensity, duration and exercise selection can be predetermined by one's own fitness level and personal goals.

The present invention provides an extremely versatile exercise platform with a plethora of uses by trainers, in home or in sports specific training settings. It is also compatible with many existing exercise protocols with certified training strategies. The key to finding an effective program that makes substantial bounds in overall fitness is integrating both cardio training with anaerobic training. Doing this in combination results in an increased intensity and a decrease in the amount of time training. The present invention does this by combining both cardiovascular and anaerobic training into one continuous training system. As mentioned above, one is only limited to one's own imagination and physical capabilities in using the present invention.

Novel and Patentability

There are many major differences between present invention and the prior art but first let's examine the similarities. They are both tension devices which load the body in different planes of motion forcing the body to overcome stress in those planes of motion. The prior art does this by exerting loading on the core and the feet. However, and most important, the prior art does this through only one plane of motion. The prior art does not achieve the same effects as present invention. The present invention forces the body to undergo simultaneous, constant tension on the entire core and lower body movement systems ("Lumbo-Pelvic-Hip Complex") in all three planes of motion (sagittal, transverse, and frontal). The prior art places tension primarily in only one plane of motion at any point in time. In addition, the prior art is designed to create a rate of force production which causes stimulation of mostly fast-twitch muscle fiber producing explosive power. The present invention causes stimulation of both fast-twitch and slow-twitch muscle fibers.

In addition, the present invention has a novel belt and unique anchoring configuration, which makes the workout three-dimensional by simultaneously and continuously loading the body's core and movement systems in all three planes of motion. With the present invention's innovative approach one doesn't have to worry about moving into the plane of motion one wants to work, the present invention automatically puts one in the appropriate plane of motion. This means the present invention is completely different and unique from the prior art and always keeps the body loaded in the three planes of motion, i. e., sagittal, transverse, and frontal planes. The present invention distributes simultaneous constant stress on the body in these three planes of motion which makes this comprehensive but simple system profoundly different than the prior art.

Furthermore, the present invention can go from a vertical loaded orientation to a horizontal loaded orientation automatically, while never having to reconfigure the lines of tension, as is required with the prior art. This is a significant, novel step forward. This makes the exercise regimen more fluid, time-efficient, less costly, and importantly more effective. Due to the present invention's ingenious anchoring, belting and loading system, the body is constantly under stress, even at rest, which makes the body feel as if it is loaded in all three planes of motion at the same time. This causes never-ending muscle demand, forcing higher levels of recruitment on both fast-twitch and slow-twitch muscle fibers.

The present invention refers to this effect on the core and the lower body movement systems as core amortization which is something not achieved by using the prior art. The present invention's ability to produce core amortization has a profound application for athletic training, fitness maintenance and physical therapy and rehabilitation. Not only does it continually create loading on the core in all three planes of motion, it forces copious levels of perturbation challenges causing hyper-queuing to take place in the core. This hyper-activation of the core makes the present invention a significant improvement over the prior art for athletic training, fitness maintenance and physical therapy and rehabilitation.

Advantages of the Present Invention Over Other Prior Artwork

The most pronounced advantage of the present invention over the prior art is that it keeps an individual's core and lower body continuously, evenly loaded during the exercise regimen, even while pausing between individual exercises. The present invention forces an individual to work out continuously, without a recovery period. This happens because of the unique features of the present invention, which put simultaneous, constant tension on the core and body movement systems in all three planes of motion, something the prior art does not provide. Further this forces the body to work aerobically and anaerobically at the same time, something that the prior art does not provide.

The present invention also improves functional athletic activities, movements, and skills, which the prior art does not provide. The present invention enhances the body's ability to coordinate the kinetic chain to produce quick and accurate movements in all directions.

The present invention accomplishes this by generating stimulating hyper-contractions providing neural adaptations, which enhance neuromuscular efficiency. This increased stimulation enables the core and lower body movement systems (Lumbo-Pelvic-Hip Complex) to operate more effectively and efficiently by facilitating more muscle recruitment and synchronization and augmenting the body's proprioception through constant hyper-queuing of the core through mutli-planar lines of tension caused by the anchoring system and tension bands. In short, the present invention can simultaneously train the core and lower body to stabilize and strengthen in the three different planes of motion, whereas the prior art does not.

The present invention provides the small and large musculo-skeletal systems a better platform by which to work together more synergistically. The present invention does this with the unique belt and loading system which causes a higher level of stimulation on the local muscle and tendon groups. The large muscle groups are predominantly responsible for movement and power, whereas small muscle and tendon groups are located in close proximity to the joints and mainly provide support and stabilization.

The unique anchoring, belting, and loading system of the present invention forces anaerobic and aerobic training to occur in conjunction with each other, something that is lacking in the prior art.

In addition, the present invention forces increased amortization of the eccentric and concentric contractions of the muscles and tendons being exercised, by creating constant micro-changes in the direction and loading of the kinetic chain. This produces a revolutionary method of challenging the body's core and movement systems through continuous lines of tension forced on the core and lower body during exercise by the present invention.

No fitness product on the market has shown the effectiveness, versatility, portability and low price point as the present invention.

The present invention's unique design provides a more efficient recruitment of the internal abdominal pressure mechanism (transverse abdominus, internal obliques, pelvic floor, multifidus and deep erector spinae group). By providing simultaneous, constant, multi-planar loading on the core, the present invention forces the internal abdominal pressure mechanism to be engaged at all times with equal loading, leading to greater overall strength and stability. This creates core integrity and equal lines of tension in all parts of the internal abdominal pressure mechanism, something the prior art does not provide.

The present invention's components are highly durable, lightweight and simple to assemble as well as use. The present invention's configuration allows it to be easily integrated into other training platforms and methods which make it a highly desirable training system.

In summary, the present invention's components include:

a. Canvas nylon belt that is extremely strong;
b. 2 durable plastic belt clips that allow the belt to fit almost any user from portly to slim;
c. 5 aluminum safety clips or carabiners to attach to anchoring system and belt;
d. 3 anchor systems made up of (3) 6" eye hooks;
e. 3 durable nonskid pads where the eye hooks fasten into to secure anchors;
f. Choice of using 45 lb. plates to stabilize the anchors or plastic water-filled anchors provided with each system;
g. 3 surgical tubing elastic bands that provide tension for the device;
h. 2 Neoprene sleeves to keep the belt clips from irritating the user;
i. 1 belt hip stabilizer made from Neoprene and canvas to keep the belt from slipping.

The stabilizer fits around the back portion of the belt; and the Y-assembly system made, up of the same canvas blend as the belt allows the user to be able to change orientation from vertical to horizontal without making any adjustments to the belt or anchoring system.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is intended to cover by the appended claims all such modifications as fall within the scope of the claims.

I claim:

1. A core amortization time under tension system comprising:

three floor anchors, configured to be placed in a triangular configuration around a user such that two of the floor anchors are positioned behind the user and one of the floor anchors is positioned in front of the user;

a waist belt configured to be secured around the user's waist, the waist belt having two attachment loops in rear of the belt and further having two attachment loops in the front of the belt;

a Y assembly secured to the two attachment loops in the front of the belt; and three elastic bands, each elastic band configured to be secured to one of the three floor anchors and the waist belt, such that two of the elastic bands secure the two floor anchors positioned behind the user to the two attachment loops in the rear of the belt, and the third elastic band secures the floor anchor positioned in front of the user to an end loop secured to the Y assembly.

2. The core amortization time under tension system of claim 1, wherein:

the waist belt includes a first fastener clip configured on the waist belt to close the waist belt around the user and configured to adjust an overall length of the waist belt around the user's waist.

3. The core amortization time under tension system of claim 2, wherein:

the waist belt further includes a second fastener clip configured on the waist belt to adjust a position of the Y assembly on the waist belt.

4. The core amortization time under tension system of claim 3, wherein the system further includes a first sleeve configured to slide over the first fastener clip and a second sleeve configured to slide over the second fastener clip.

5. The core amortization time under tension system of claim 1, wherein the Y assembly includes two arms, each with a looped end positioned at the end of each arm, and the two arms further extend out from a central leg, the central leg having a plurality of fabric loops positioned along the central leg from a region adjacent to the two arms to a free end of the central leg, and wherein the third elastic band secures the floor anchor positioned in front of the user to the end loop being a fabric loop of the central leg to secure the waist belt and the Y assembly to the front anchor.

6. The core amortization time under tension system of claim 5, wherein to increase a tension in the system, the third elastic band is moved to one of the plurality of fabric loops closer to the two arms.

7. The core amortization time under tension system of claim 1, wherein each of the floor anchors is defined as having:

a base plate configured to rest on a surface, a rod extending from the base plate and having an eye hook on an end distal to the base plate, and a weight positioned over the rod to rest on the base plate to maintain the floor anchor in position when in use.

8. The core amortization time under tension system of claim 1, wherein each of the floor anchors is defined as having a rod secured directly to the surface and having an eye hook on an end distal to a surface.

9. The core amortization time under tension system of claim 1, wherein each of the floor anchors is positioned in a triangular formation on the floor, such that the three floor anchors are configured as a single front anchor positioned in front of the user and two back anchors positioned behind the user, and wherein the front anchor is approximately seven feet from the back anchors and the two back anchors are approximately four feet apart from each other.

10. A core amortization time under tension system comprising:

three floor anchors, configured to be placed in a triangular configuration around a user such that two of the floor anchors are positioned behind the user and one of the floor anchors is positioned in front of the user;

a waist belt configured to be secured around the user's waist, the waist belt having two attachment loops in rear of the belt and further having two attachment loops in the front of the belt, wherein the waist belt is a two-piece belt defined by a front belt component and a rear belt component, the waist belt further includes a first fastener clip configured to close the waist belt around the user and configured to adjust a rear length of the waist belt around the user's waist, and the waist belt further includes a second fastener clip configured on the waist belt to adjust a front length of the waist belt around such that a position of the Y assembly on the waist belt is adjustable;

a Y assembly secured to the two attachment loops in the front of the belt; and three elastic bands, each elastic bands configured to be secured to one of the three floor anchors and the waist belt, such that two of the elastic bands secure the two floor anchors positioned behind the user to the two attachment loops in the rear of the belt, and the third elastic band secures the floor anchor positioned in front of the user to an end loop secured to the Y assembly.

11. The core amortization time under tension system of claim 10, wherein the Y assembly includes two arms, each with a looped end positioned at the end of each arm, and the two arms further extend out from an central leg, the central leg having a plurality of fabric loops positioned along the central leg from a region adjacent to the two arms to a free end of the central leg, and wherein the third elastic band secures the floor anchor positioned in front of the user to the end loop being a fabric loop of the central leg to secure the waist belt and the Y assembly to the front anchor.

12. The core amortization time under tension system of claim 11, wherein to increase a tension in the system, the third elastic band is moved to one of the plurality of fabric loops closer to the two arms.

13. The core amortization time under tension system of claim 10, wherein each of the floor anchors is defined as having a rod secured directly to the surface and having an eye hook on an end distal to a surface.

14. The core amortization time under tension system of claim 10, wherein each of the floor anchors is positioned in a triangular formation on the floor, such that the three floor anchors are configured as a single front anchor positioned in front of the user and two back anchors positioned behind the user, and wherein the front anchor is approximately seven feet from the back anchors and the two back anchors are approximately four feet apart from each other.

15. The core amortization time under tension system of claim 10, wherein the system further includes a first sleeve configured to slide over the first fastener clip and a second sleeve configured to slide over the second fastener clip.

16. The core amortization time under tension system of claim 10, wherein each of the floor anchors is defined as having:

a base plate configured to rest on a surface, a rod extending from the base plate and having an eye hook on an end distal to the base plate, and a weight positioned over the rod to rest on the base plate to maintain the floor anchor in position when in use.

* * * * *